US007070216B2

(12) United States Patent
von zur Muehlen

(10) Patent No.: US 7,070,216 B2
(45) Date of Patent: Jul. 4, 2006

(54) VEHICLE DOOR HANDLE ASSEMBLY

(75) Inventor: Patrick A. von zur Muehlen, St. Louis, MO (US)

(73) Assignee: Siegel-Robert, Inc., St. Louis, MO (US)

( * ) Notice: Subject to any disclaimer, the term of this patent is extended or adjusted under 35 U.S.C. 154(b) by 63 days.

(21) Appl. No.: 10/936,924

(22) Filed: Sep. 9, 2004

(65) Prior Publication Data

US 2006/0049647 A1 Mar. 9, 2006

(51) Int. Cl.
*E05B 3/00* (2006.01)

(52) U.S. Cl. ..... 292/336.3; 292/92; 292/347; 292/DIG. 22; 292/DIG. 65; 70/92

(58) Field of Classification Search ..... 292/336.3, 292/92, 347, DIG. 22, DIG. 65; 70/92
See application file for complete search history.

(56) References Cited

U.S. PATENT DOCUMENTS

| | | | | |
|---|---|---|---|---|
| 3,583,741 | A | 6/1971 | Breitschwerdt et al. | |
| 3,719,248 | A | 3/1973 | Breitschwerdt et al. | |
| 3,799,596 | A | 3/1974 | Nozomu et al. | |
| 3,990,531 | A | 11/1976 | Register | |
| 4,536,021 | A | 8/1985 | Mochida | |
| 5,558,372 | A | 9/1996 | Kapes et al. | |
| 5,669,642 | A | 9/1997 | Kang | |
| 5,769,471 | A | 6/1998 | Suzuki et al. | |
| 5,865,481 | A | 2/1999 | Buschmann | |
| 6,007,122 | A | 12/1999 | Linder et al. | |
| 6,010,167 | A | 1/2000 | Tanimoto et al. | |
| 6,042,159 | A | 3/2000 | Spitzley et al. | |
| 6,067,869 | A | 5/2000 | Chilla et al. | |
| 6,099,052 | A | 8/2000 | Spitzley | |
| 6,241,294 | B1 | 6/2001 | Young et al. | |
| 6,264,257 | B1 * | 7/2001 | Meinke | 292/336.3 |
| 6,554,331 | B1 | 4/2003 | Ciborowski et al. | |
| 6,565,134 | B1 | 5/2003 | Stuart et al. | |
| 6,575,508 | B1 | 6/2003 | Stuart et al. | |
| 6,612,630 | B1 * | 9/2003 | Meinke | 292/348 |
| 6,648,382 | B1 | 11/2003 | Mönig et al. | |
| 6,709,033 | B1 * | 3/2004 | Jooss et al. | 292/336.3 |
| 6,719,336 | B1 | 4/2004 | Sato | |
| 6,749,236 | B1 * | 6/2004 | Nomura et al. | 292/336.3 |
| 2003/0001399 | A1 | 1/2003 | Sato | |
| 2003/0111850 | A1 * | 6/2003 | Kwak | 292/336.3 |
| 2005/0161959 | A1 * | 7/2005 | Belchine, III | 292/336.3 |

FOREIGN PATENT DOCUMENTS

| | | |
|---|---|---|
| JP | 3-279573 | 12/1991 |
| JP | 10-205181 | 8/1998 |
| JP | 2000-257309 | 9/2000 |
| JP | 2001-140506 | 5/2001 |
| JP | 2001-227206 | 8/2001 |

* cited by examiner

*Primary Examiner*—Brian E. Glessner
*Assistant Examiner*—Carlos Lugo
(74) *Attorney, Agent, or Firm*—Senniger Powers

(57) ABSTRACT

A door handle assembly which is compact in size for space-efficient packaging in a door of an automotive vehicle. The assembly includes a safety system for preventing inadvertent movement of the handle to an unlatched position during a side impact collision. A counterweight is mounted in the handle assembly which, during relative motions of parts induced by acceleration from a side impact, resists unlatching the handle. The counterweight is rotatably mounted on an axis different from an axis of the handle latch control mechanism, and is not fixedly attached to the handle mechanism.

19 Claims, 10 Drawing Sheets

VEHICLE DOOR HANDLE ASSEMBLY

BACKGROUND OF THE INVENTION

This invention relates generally to door latches for vehicles, and in particular to a safety system in a door handle assembly which is compact in size for space-efficient packaging in the door.

Doors on cars and trucks include a handle assembly for latching and unlatching the door to the vehicle body so that the door can be swung open and also held in a shut position. A safety system is conventionally incorporated so that a side impact collision does not inadvertently cause the handle to move into an unlatched position, thereby allowing the door to open and exposing occupants to greater risk of being expelled from the vehicle. Typically, the safety system uses a counterweight mounted in the handle assembly which, in response to acceleration induced by a side impact, opposes or prevents movement of the handle to the unlatched position.

Recent vehicles feature doors of decreased thickness that require thinner and more compact handle assemblies. Unfortunately, conventional handle assemblies frequently have counterweights which are thick, bulky, located relatively far from the operating part of the handle assembly, or otherwise difficult to integrate into the door with a smooth contour and low profile.

SUMMARY OF THE INVENTION

In general, a door handle assembly according to the present invention is for a vehicle door that resists opening of a latch mechanism of the door under inertial forces. The door handle assembly comprises a handle movable from a door latched position to a door unlatched position. A bell crank is operatively connected to the handle so that movement of the handle rotates the bell crank about a bell crank axis. The bell crank has a first lever arm adapted for attachment to the latch mechanism of the door, and a cam. A counterweight is mounted for pivoting about a counterweight axis spaced from the bell crank axis. The counterweight is positioned for engagement with the cam such that when the handle is pulled from the door latched position to the door unlatched position, the bell crank rotates and the cam pushes the counterweight in a first direction about the counterweight axis. But upon acceleration of the handle assembly tending to cause the handle to move by its own inertia from the door latched to the door unlatched position thereby urging the bell crank to rotate, the inertia of the counterweight urges it to pivot in a second direction about the counterweight axis opposite the first direction and bear against the cam for inhibiting rotation of the bell crank and movement of the handle to the door unlatched position.

In another aspect, a door handle assembly of the invention is for a vehicle door that resists opening of a latch mechanism of the door under inertial forces. The door handle assembly comprises a handle movable from a door latched position to a door unlatched position. A latch control mechanism is operatively connected to the handle so that movement of the handle moves the latch control mechanism. A counterweight is mounted for pivoting about a counterweight axis and free of fixed connection to the latch control mechanism. The counterweight is positioned for contact with the latch control mechanism such that when the handle is pulled from the door latched position to the door unlatched position, the latch control mechanism moves and pushes the counterweight in a first direction about the counterweight axis. But upon acceleration of the handle assembly tending to cause the handle to move by its own inertia from the door latched to the door unlatched position thereby urging the latch control mechanism to move, the inertia of the counterweight urges it to pivot in a second direction about the counterweight axis opposite the first direction and bear against the latch control mechanism for inhibiting rotation of the latch control mechanism and movement of the handle to the door unlatched position. The counterweight and latch control mechanism in the door latched position are contained in a volume less than or equal to about 150 $cm^3$.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
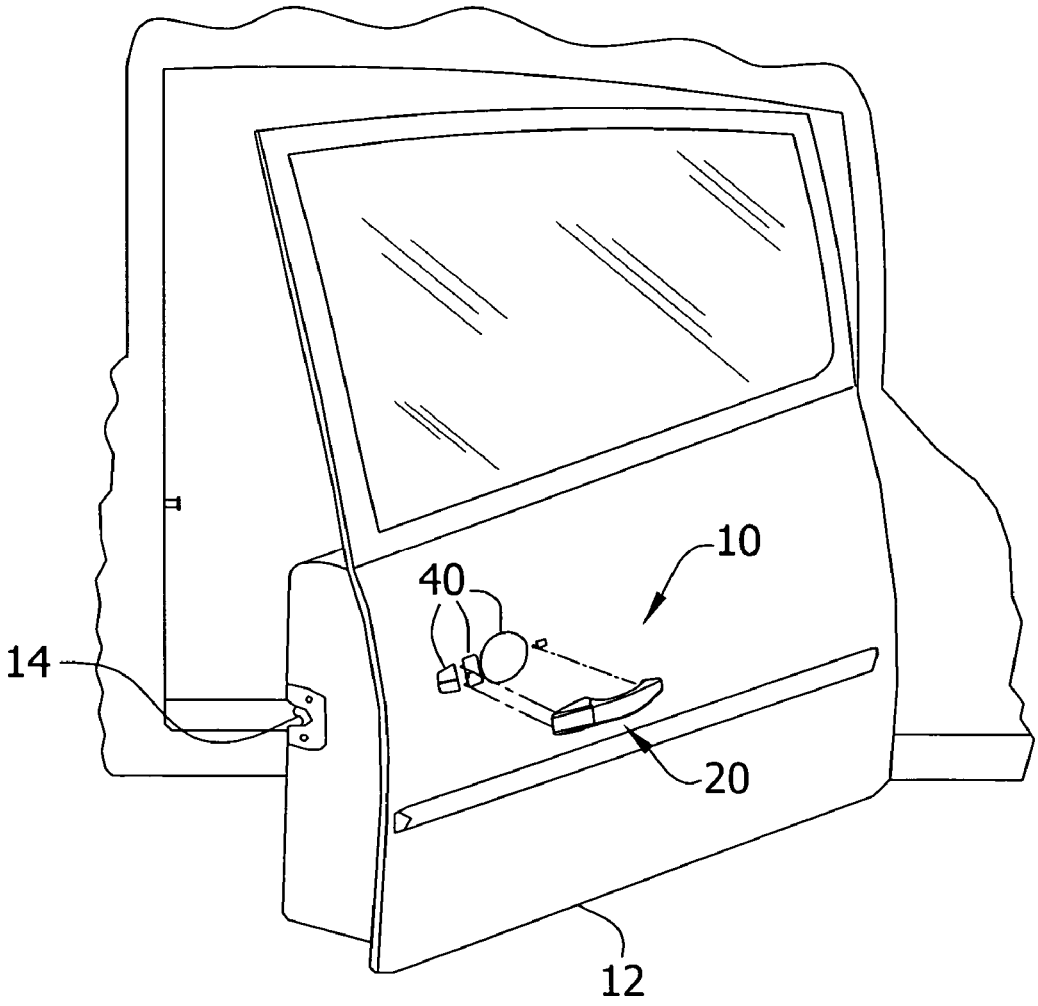
FIG. 1 is a fragmentary perspective, partially exploded, of a lateral side of a vehicle with a door handle assembly of the present invention.
Figure 1A:
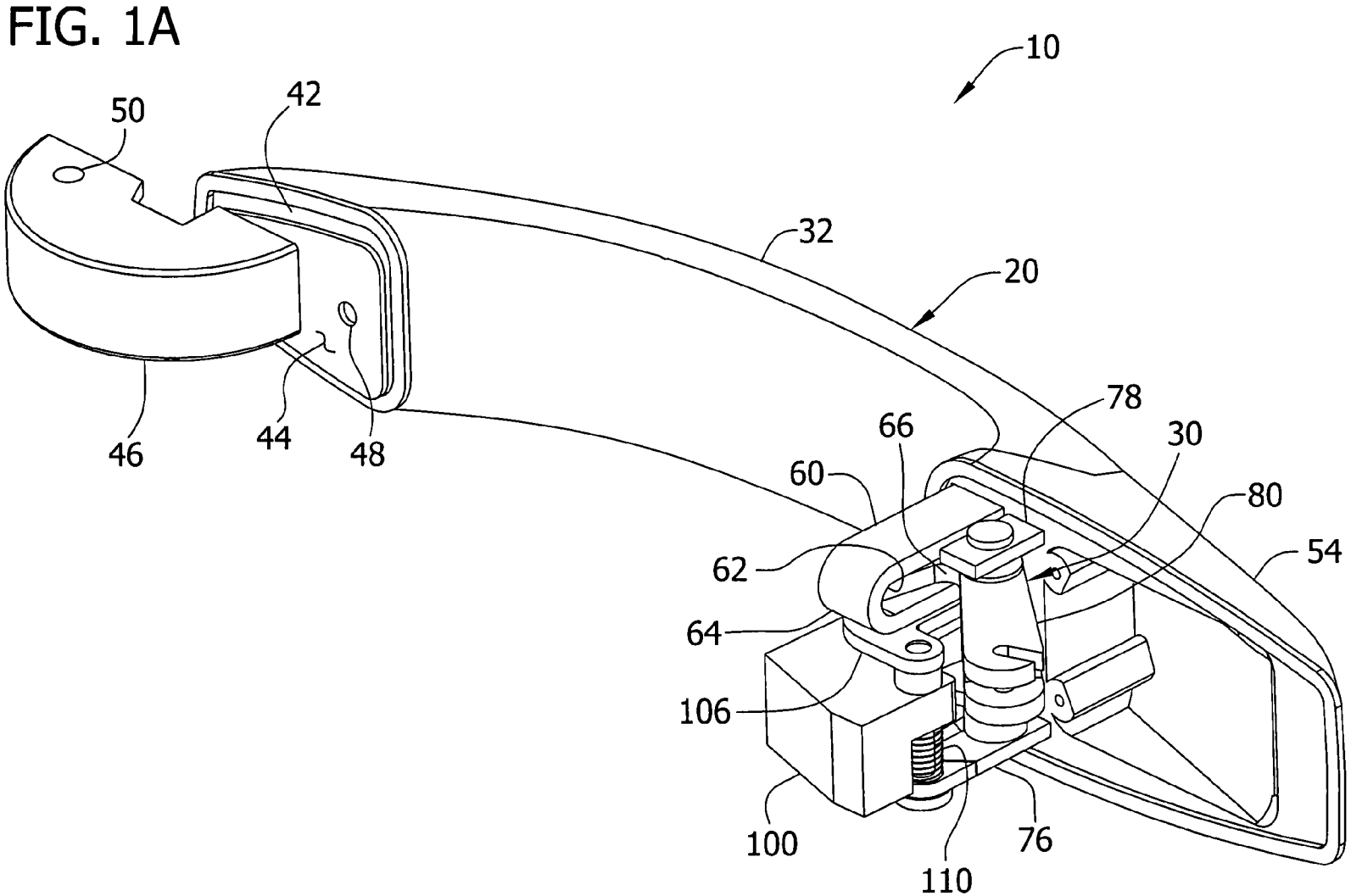
FIG. 1A is a perspective of the door handle assembly of FIG. 1.

Referring now to the drawings and in particular to FIGS. 1 and 1A, a door handle assembly according to the present invention is indicated generally at 10. The assembly 10 is installed in a door 12 of a vehicle, such as a car or truck, for controlling a door latch mechanism 14 in unlatching the door from the vehicle body to open the door. The assembly 10 also inhibits inadvertent opening of the door 12 when the vehicle is involved in a collision, particularly an impact on a side of the vehicle which results in accelerations and/or forces in a lateral direction.

Figure 6:
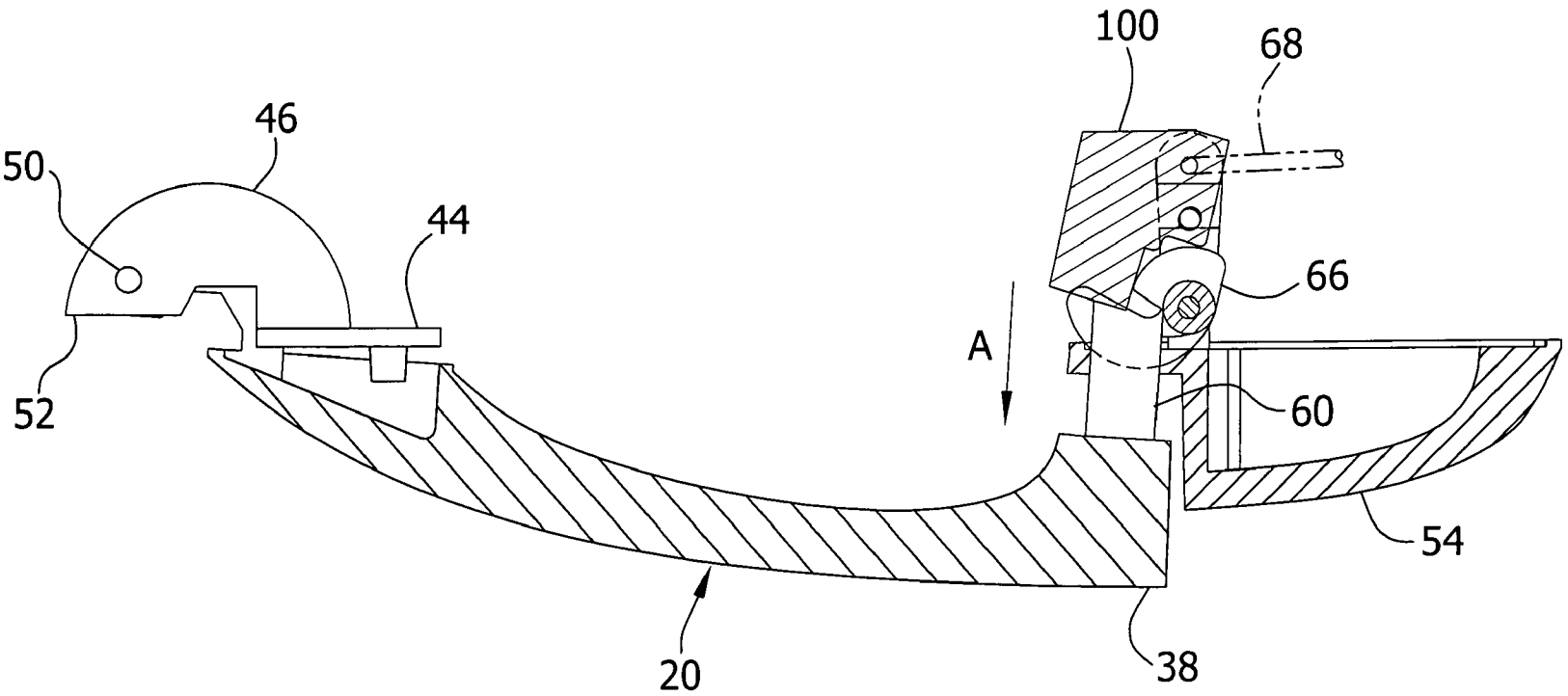
FIG. 6 is a horizontal section taken along line 6—6 of FIG. 2, but with the handle pivoted outwardly to an unlatch position.

The assembly 10 includes a handle and a latch control mechanism, indicated generally at 20 and 30, respectively. The handle 20 has a horizontal grip portion 32 for gripping the handle, a tail 34 (FIG. 3) at a first end 36 of the handle, and a connection to the latch control mechanism 30 at a second, opposite end 38. The handle 20 is pivotally movable between a latched position (FIG. 3) and an unlatched position (FIG. 6). In one embodiment as shown in FIG. 1, the assembly 10 is received in openings 40 in the door panel 12 and installed in the vehicle door with the tail 34 of the handle located at a relatively forward position and the latch control mechanism 30 at a relative rearward position. That arrangement places the latch control mechanism 30 at closer proximity to the door latch mechanism 14 for operative connection therebetween. Other arrangements do not depart from the scope of the invention.

Figure 2:
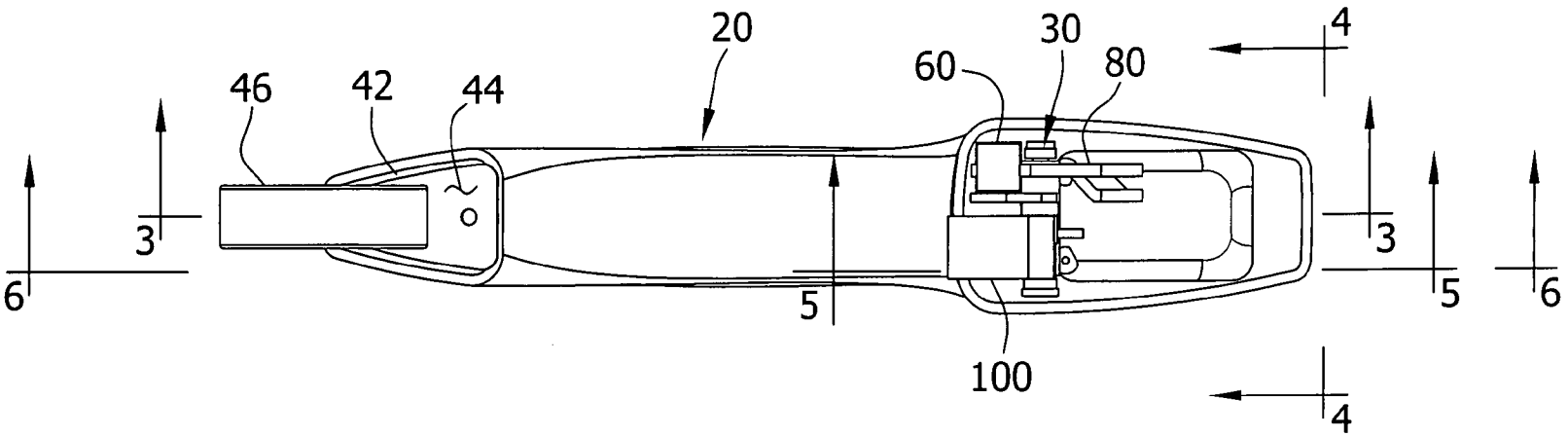
FIG. 2 is an elevation of the door handle assembly of FIG. 1 as viewed from interior of the door.

The assembly 10 further includes a base 42 for securing the handle 20 to the door and establishing its pivotal motion. The base 42 includes a flat surface 44 (FIGS. 1A and 2) which engages the door panel 12 and a semi-circular shaped hood 46. The surface 44 has a fastener hole 48 which receives a fastener (not shown) to secure the base 42 and handle 20 to the door panel. The hood 46 projects from the flat surface 44 into the interior of the door panel. The hood 46 is configured for receiving and enclosing the tail 34 of the handle. The base 42 remains at a fixed position on the door panel 12, and the handle 20 pivots about the base 42. A center of rotation 50 of the handle 20 is shown in FIG. 6, the center defining a handle axis which is substantially vertical. An outer end 52 of the hood 46 rests against an inner side of the door panel 12 at a location spaced from the flat surface 44 and stabilizes the assembly 10 against rotation relative the door.

Figure 5:
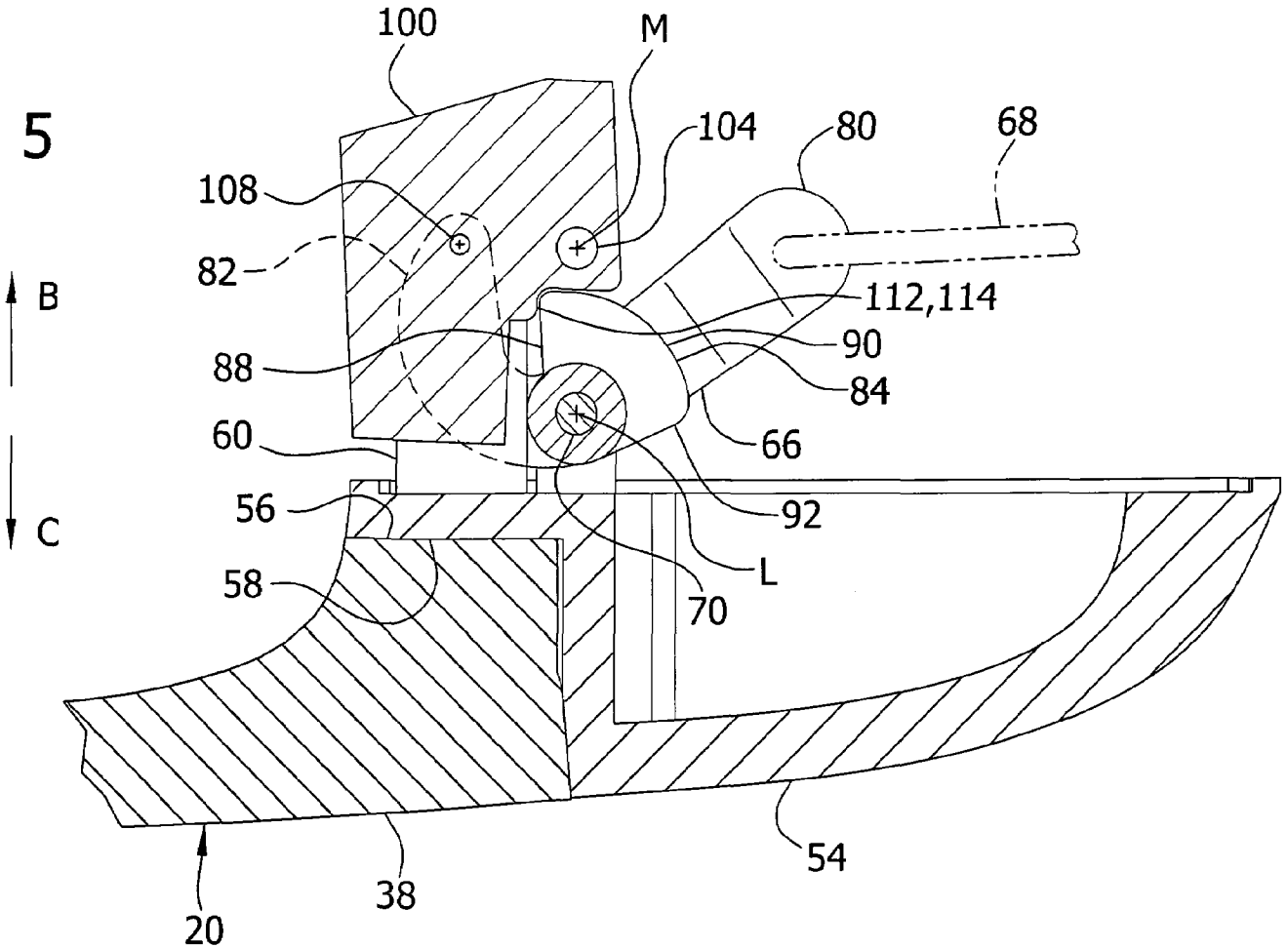
FIG. 5 is an enlarged, fragmentary horizontal section taken along line 5—5 of FIG. 2.

At the opposite, second end 38 of the handle 20, a bracket 54 covers the latch control mechanism 30 and is shaped to provide a smooth external surface contour between the door panel and handle when the handle is at the latched position. The bracket 54 is fixedly secured to the door panel 12 by one or more fasteners (not shown). As shown in FIG. 5, the second end 38 of the handle is shaped to rest against the bracket 54 when the handle is at the latched position, with a flat surface 56 of the handle engaging a flat surface 58 of the bracket.

The handle 20 is operatively connected at its second end 38 to the latch control mechanism 30 such that, in ordinary operation, movement of the handle to the unlatched position causes the door latch mechanism 14 to unlatch from connection to the door frame so that the door 12 may be opened. A finger 60 (FIGS. 5 and 6) projects from the second end of the handle 20 in a direction generally perpendicular to the door panel. The finger 60 is fixedly connected to the handle 20 and extends through an opening (not shown) in the flat surface 58 of the bracket. As shown in FIG. 1A, the finger 60 has an elongate body with a central slot 62 and a solid, curved end 64 which closes the free end of the slot. When the handle 20 pivots from the latched position to the unlatched position, the finger 60 moves in the direction of arrow A (FIG. 6).

Figure 3:
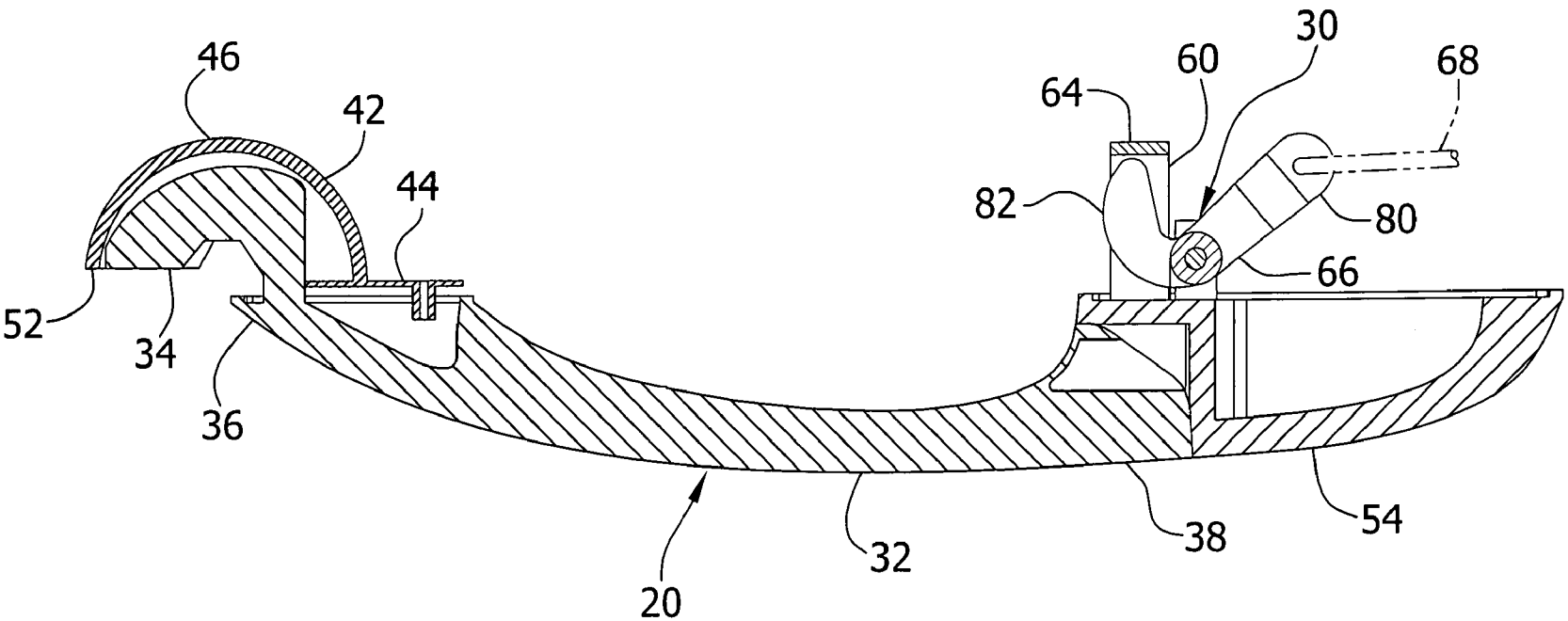
FIG. 3 is a horizontal section along line 3—3 of FIG. 2 with the handle at a latched position.
Figure 4:
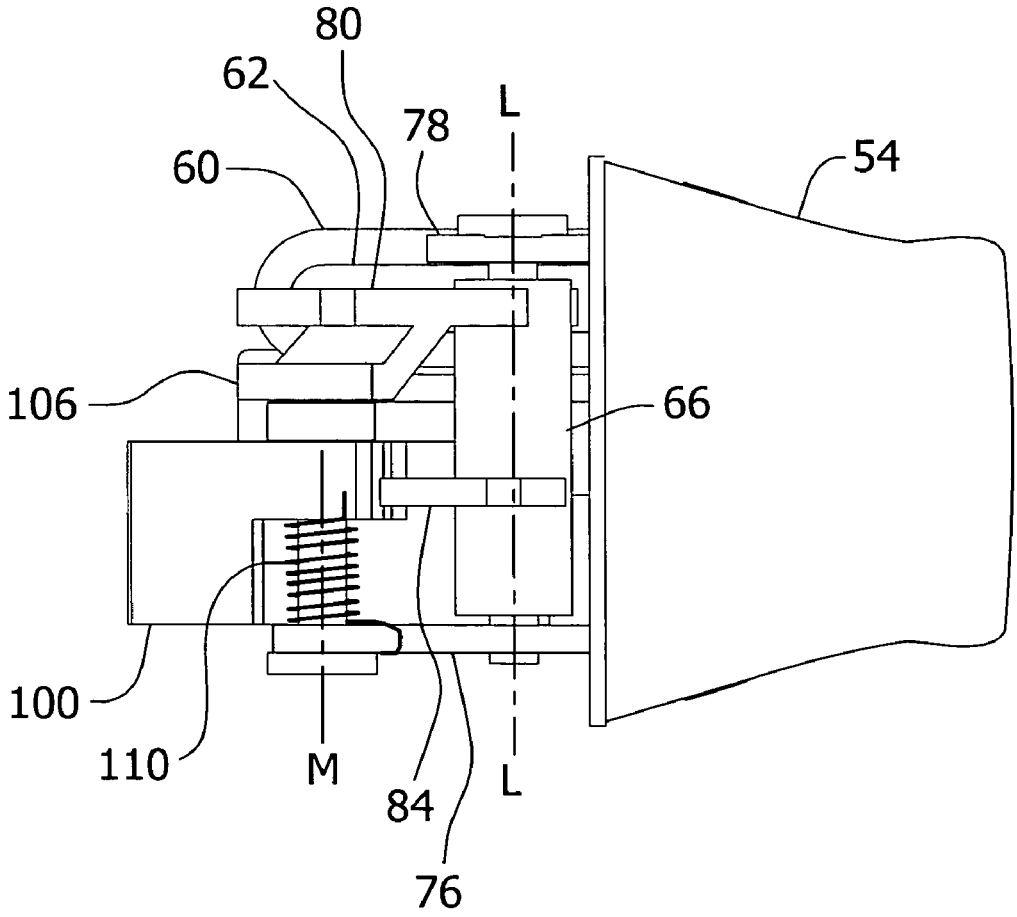
FIG. 4 is an elevation seen from the vantage indicated by line 4—4 of FIG. 2.
Figure 7:
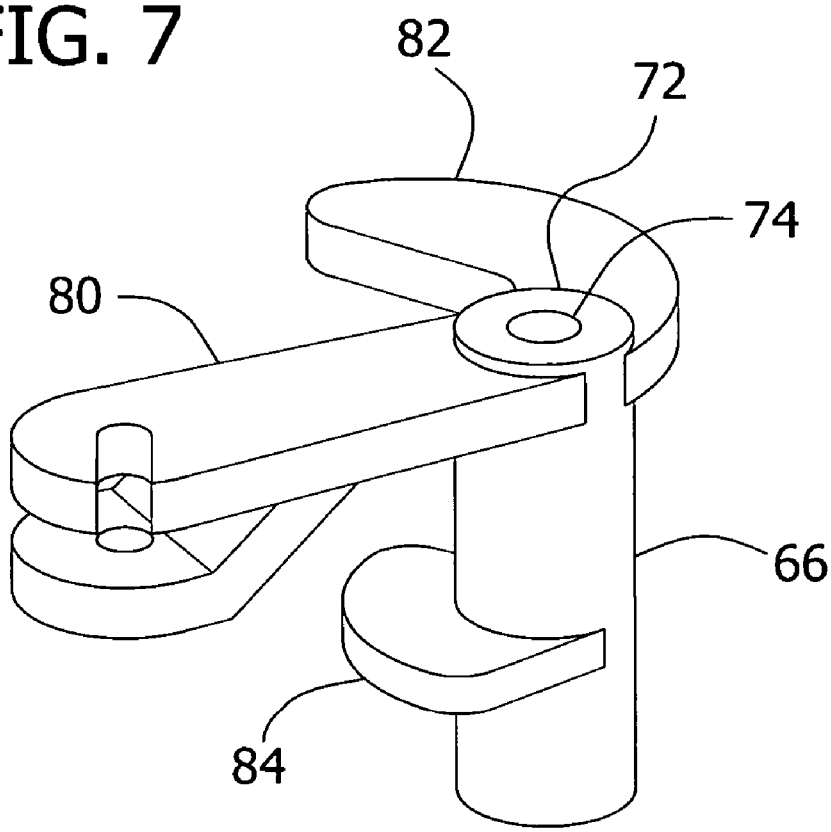
FIG. 7 is a perspective of a bell crank of the door handle assembly.

The latch control mechanism 30 comprises a bell crank 66 which transfers force from the handle 20 into motion of a linking cable 68 (FIGS. 3 and 5) which connects the latch control mechanism to the door latch 14. The bell crank 66 is mounted for rotation about a hinge 70 defining a bell crank axis L (FIG. 4). In one embodiment, the bell crank axis is substantially vertical. Referring to FIG. 7, the bell crank 66 has a cylindric hub or post 72 with a bore 74 for receiving a hinge pin to mount the bell crank between two supports 76, 78 of the assembly. A first lever arm 80 extends outward from the post 72, substantially horizontally, and has a clevis end for attachment to the linking cable 68. A second lever arm 82 extends from the post 72, generally in the same horizontal plane as the first lever arm 80 but in the opposite direction. In one embodiment, the first lever arm 80 is generally straight while the second lever arm 82 curves more than 90 degrees, forming in combination a hook shape to the arms as shown in FIGS. 3 and 5. The second lever arm 82 is received in the slot 62 of the finger 60 and curves toward the free end 64 of the finger. Other configurations for transferring force from the handle to the linking cable do not depart from the scope of this invention. Further, the bell crank axis may have other orientations and arm(s) may have other shapes and orientations.

The bell crank 66 is positioned closely adjacent the inner side of the door panel 12 and the finger 60 of the handle. When the handle 20 pivots to the unlatched position and the finger 60 moves in a direction A (FIG. 6), the end 64 of the finger pulls the second lever arm 82 and causes the bell crank 66 to rotate. The direction of rotation of the bell crank is counter-clockwise, as viewed in FIGS. 5 and 6. The first lever arm 80 simultaneously pulls the cable 68, overcoming force urging the cable to the latched position. Movement of the linking cable 68 away from the latch mechanism 14 (i.e., when the first lever arm 80 rotates counter-clockwise) effects unlatching of the door. When the handle 20 is released, it returns (via spring bias) to the latched position with the finger 60 moving opposite the direction A, permitting the second lever arm 82 and bell crank 66 to rotate in a clockwise direction. Movement of the linking cable 68 toward the latch mechanism 14 (i.e., when the first lever arm 80 rotates clockwise) allows the latch mechanism to latch the door, or if the door remains open, allows movement of the latch mechanism to its latched position without actually latching to the vehicle frame.

The bell crank 66 has a cam 84 (FIG. 7) extending from the post 72 which, in one embodiment, lies in a generally horizontal plane spaced from and parallel to the plane of the first and second lever arms 80, 82. The cam 84 extends around a circumferential portion of the post 72 and is positioned below and in general alignment with the first lever arm 80. An outer peripheral edge of the cam 84 includes a leading edge 88 (FIG. 5), which is straight, an arcuate circumferential edge 90, and a straight trailing edge 92 which lies generally tangent to the outer surface of the post.

Figure 8:
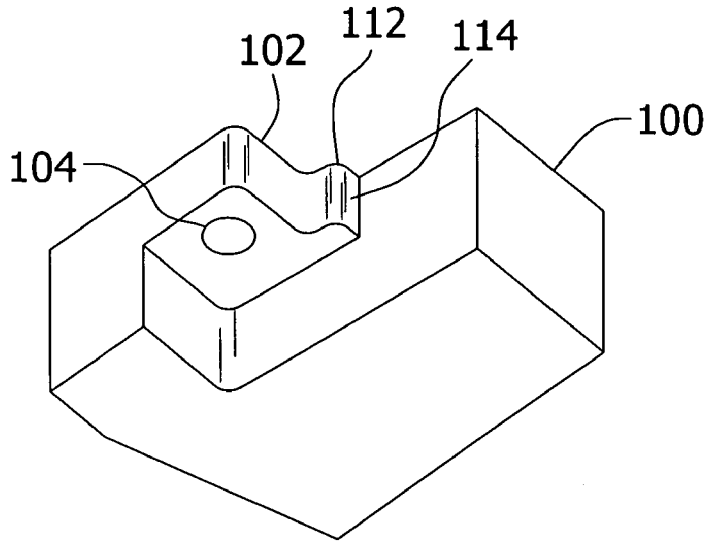
FIG. 8 is a perspective of a counterweight of the invention.
Figure 9:
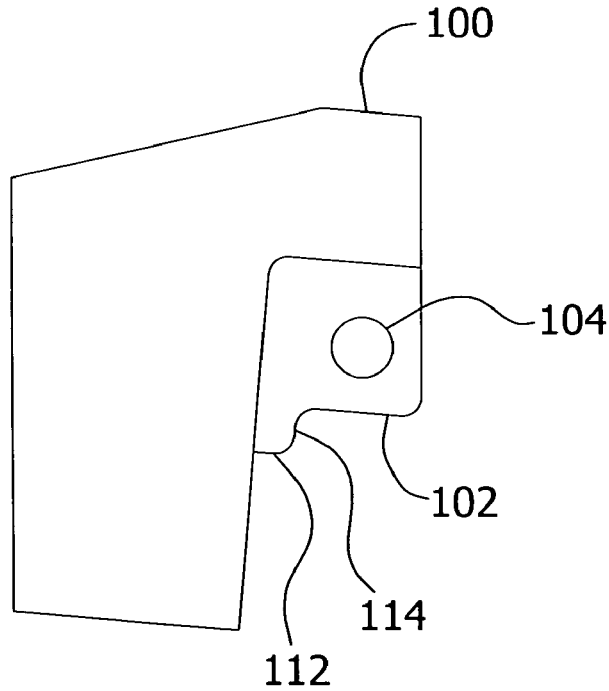
FIG. 9 is a bottom plan of the counterweight.

A counterweight 100 is mounted in the assembly 10 as a safety system to prevent rotation of the bell crank 66 when the vehicle is involved in a side-impact collision. The counterweight 100 is free of fixed connection to the latch control mechanism 30, being rotatably mounted separate from the bell crank 66 in an arrangement for engaging the bell crank. As shown in FIGS. 8 and 9, the counterweight 100 is a solid, generally L-shaped block with flat sides and straight edges. The counterweight is shaped and configured to fit closely adjacent to the inner side of the door panel 12 and bell crank 66 for providing space-efficient installation in the vehicle door, which has tightly limited volume constraints. In this regard, a portion of the counterweight 100 is in vertical registration with the finger 60 and the second lever arm 82, shown in FIG. 5, when in the door latched position.

The counterweight 100 has a mounting formation 102 with a generally rectangular shape and a thickness less than adjacent portions of the counterweight. A bore 104 extends through the mounting formation 102 for receiving a hinge extending between fixed support 76 and a support 106 to mount the counterweight for pivotal motion. The hinge defines a counterweight axis of rotation M (FIG. 4) which in one embodiment is co-planar with, parallel to, and spaced from the bell crank axis L. The counterweight axis M is located toward one side of the counterweight 100, being spaced from a center of mass 108 of the counterweight, as shown in FIG. 5. The center of mass 108 is generally on the same side of the counterweight axis M as the location where the counterweight engages the cam 84. A torsional spring 110 (FIG. 4) is placed around the hinge to urge the counterweight 100 to rotate toward the bell crank 66, i.e., counter-clockwise in the views of FIGS. 5 and 6. It is understood that the counterweight can have other shapes and configurations without departing from the scope of this invention.

A foot 112 (FIG. 8) protrudes from the mounting formation 102 and functions as a stop, as discussed below. The foot 112 defines a flat shoulder 114 and a smoothly contoured tip. The outer surface of the counterweight 100 comprises a cam follower. Due to the force of the spring 110, the counterweight continually engages the cam 84 (i.e., the outer edges 88, 90 of the cam) as the bell crank 66 rotates.

In normal operation, the counterweight 100 does not inhibit operation of the latch 14. Referring to FIG. 5 showing the latched position, the shoulder 114 of the foot 112 is in engagement with the leading edge 88 of the cam 84. The force of the spring 110 urges the counterweight 100 to bear against the bell crank 66, more specifically, the foot 112 contacts and bears against the leading edge 88. The operator pulls the handle 20 toward the unlatched position, rotating the bell crank 66 and easily overcoming the opposing force. As the bell crank 66 rotates in the counter-clockwise direction, the cam 84 pushes against the counterweight 100 which causes the counterweight to rotate about the counterweight axis M in the clockwise direction. The counterweight 100 pivots out of the way so that the bell crank 66 may rotate and pull the linking cable 68. As it rotates toward the unlatched position shown in FIG. 6, the counterweight 100 follows the motion of the cam 84. The counterweight 100 has a relatively small range of motion so that it may more readily fit into tight spaces in the door without interference. For example, while the bell crank 66 rotates between latched and unlatched positions an angle more than 50 degrees, the counterweight 100 rotates clockwise an angle less than 20 degrees. Other angular ranges do not depart from the scope of this invention.

When the vehicle is involved in a side impact collision, the counterweight 100 resists operation of the latch 14. When the vehicle accelerates in a lateral direction, components of the assembly 10 experience inertial forces that tend to move the components relative to the door panel 12 in a direction opposite the acceleration. Referring to FIG. 5, lateral acceleration of the vehicle in the direction of arrow B results in inertial forces on components in the direction of arrow C relative to the vehicle. The handle 20 tends to pivot to the unlatched position, thereby urging the bell crank 66 to rotate in the counter-clockwise direction. Because the counterweight's axis of rotation M is not located at the counterweight's center of mass 108, nor aligned with it, a lateral inertial force in direction C tends to rotate the counterweight 100. The rotational direction in FIG. 5 to which it is urged is counter-clockwise about the counterweight axis. Consequently, the counterweight 100 (at the shoulder 114) bears against the bell crank 66 (at the leading edge 88) with a force substantially greater than that applied in normal operation. Accordingly, the bell crank 66 is locked and cannot rotate nor push the counterweight 100. The foot 112 functions as a stop which resists or halts movement of the handle 20 to the door unlatched position.

Should the vehicle experience an opposite lateral acceleration, in the direction of arrow C on FIG. 5 (i.e., an impact on the opposite side of the vehicle), the assembly 10 does not urge the door handle 20 to move to the unlatched position. Significantly, the counterweight 100 is not fixedly attached to the latch control mechanism 30. Although the acceleration is in the direction opposite for which the assembly was designed, the counterweight 100 does not cause the handle 20 to move to the unlatched position. Inertia will cause the counterweight 100 to rotate in the clockwise direction, away from the bell crank 66. The handle 20 will bear against the bracket 54 and remain at the latched position.

Significantly, the counterweight axis M is spaced from the bell crank axis L. That provides a mechanical advantage over systems with common axes, and the counterweight 100 may be relatively smaller while producing sufficient locking force to prevent movement of the handle 20 due to inertia. Consequently, the assembly 10 may be more compact.

Preferably, the counterweight 100 and latch control mechanism 30 (when in the latched position) are contained in a volume less than or equal to about 150 $cm^3$, and more preferably the counterweight and latch control mechanism are contained in a volume less than or equal to about 74 $cm^3$.

Figure 10:
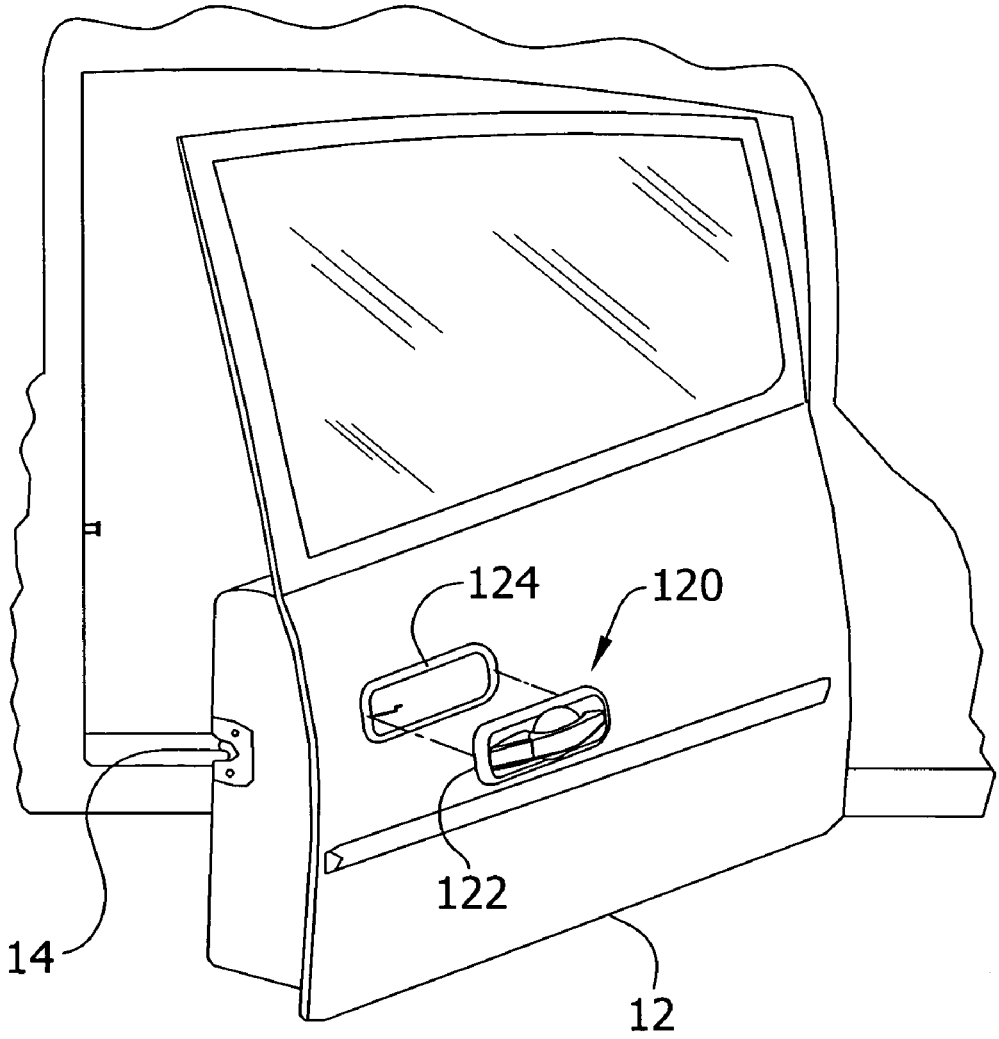
FIG. 10 is a fragmentary perspective of a lateral side of a vehicle with a door handle assembly of a second embodiment.

A second embodiment 120 of the door handle assembly is illustrated in FIG. 10. The second embodiment 120 operates in the same manner as described above, but is packaged within a unitary base 122. An outer perimeter of the base 122 is received into a single opening 124 in the door panel 12, instead of the several openings 40 in the door of the embodiment FIG. 1. The latch control mechanism 30 and the counterweight 100 are contained within the perimeter of the base 122, forming an integrated unit which is readily installed in a door panel.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A door handle assembly for a vehicle door that resists opening of a latch mechanism of the door under inertial forces, the door handle assembly comprising:

a handle movable from a door latched position to a door unlatched position;

a bell crank operatively connected to the handle so that movement of the handle rotates the bell crank about a bell crank axis, the bell crank having a first lever arm adapted for attachment to the latch mechanism of the door, and a cam;

a counterweight mounted for pivoting about a counterweight axis space from the bell crank axis, the counterweight being positioned for engagement with the cam such that when the handle is pulled from the door latched position to the door unlatched position, the bell crank rotates and the cam pushes the counterweight in a first direction about the counterweight axis, but upon acceleration of the handle assembly tending to cause the handle to move by its own inertia from the door latched to the door unlatched position thereby urging the bell crank to rotate, the inertia of the counterweight urges it to pivot in a second direction about the counterweight axis opposite the first direction and bear against the cam for inhibiting rotation of the bell crank and movement of the handle to the door unlatched position.

2. A door handle assembly as set forth in claim 1 wherein the counterweight axis is generally parallel to the bell crank axis and the center of mass of the counterweight is located on the same side of the counterweight axis where the counterweight is engageable with the cam.

3. A door handle assembly as set forth in claim 2 wherein the counterweight axis and the bell crank axis are substantially co-planar.

4. A door handle assembly as set forth in claim 1 wherein the bell crank comprises a second lever arm connected to the handle so that movement of the handle from the door latched to the door unlatched position pivots the second lever arm and bell crank about the bell crank axis.

5. A door handle assembly as set forth in claim 4 wherein at least a portion of the second lever arm and a portion of the counterweight are in vertical registration with each other in the door latched position of the handle.

6. A door handle assembly as set forth in claim 1 wherein the counterweight axis is substantially vertical when the door handle assembly is installed on a vehicle.

7. A door handle assembly as set forth in claim 6 wherein the handle is mounted on the door assembly for pivoting about a handle axis substantially parallel to the counterweight axis.

8. A door handle assembly as set forth in claim 1 further comprising a base having a perimeter, the counterweight being disposed within the perimeter of the base.

9. A door handle assembly as set forth in claim 1 wherein the counterweight includes a shoulder engaged with the cam in the door latched position of the handle.

10. A door handle assembly as set forth in claim 9 wherein the cam is generally arcuate in shape.

11. A door handle assembly as set forth in claim 10 wherein the cam has a substantially straight leading edge surface engaged with the shoulder of the counterweight in the door latched position of the handle.

12. A door handle assembly as set forth in claim 1 in combination with the vehicle door.

13. A door handle assembly for a vehicle door that resists opening of a latch mechanism of the door under inertial forces, the door handle assembly comprising:

a handle movable from a door latched position to a door unlatched position;

a latch control mechanism operatively connected to the handle so that movement of the handle moves the latch control mechanism;

a counterweight mounted for pivoting about a counterweight axis and free of fixed connection to the latch control mechanism, the counterweight being positioned for contact with the latch control mechanism such that when the handle is pulled from the door latched position to the door unlatched positions the latch control mechanism moves and pushes the counterweight in a first direction about the counterweight axis, but upon acceleration of the handle assembly tending to cause the handle to move by its own inertia from the door latched to the door unlatched position thereby urging the latch control mechanism to move, the inertia of the counterweight urges it to pivot in a second direction about the counterweight axis opposite the first direction and bear against the latch control mechanism for inhibiting rotation of the latch control mechanism and movement of the handle to the door unlatched position;

wherein the counterweight and latch control mechanism in the door latched position are contained in a volume less than or equal to about 150 $cm^3$.

14. A door handle assembly as set forth in claim 13 wherein the counterweight and latch control mechanism in the door latched position are contained in a volume less than or equal to about 74 $cm^3$.

15. A door handle assembly as set forth in claim 13 wherein at least portions of the latch control mechanism control and the counterweight are in opposed registration with each other.

16. A door handle assembly as set forth in claim 15 wherein portions of the counterweight and handle are in opposed registration with each other.

17. A door handle assembly as set forth in claim 13 wherein the rotation of the counterweight between the door latch and the door unlatch positions when the handle is pulled is less than 20 degrees.

18. A door handle assembly as set forth in claim 1 wherein the rotation of the counterweight between the door latch and the door unlatch positions when the handle is pulled is less than 20 degrees.

19. A door handle assembly for a vehicle door that resists opening of a latch mechanism of the door under inertial forces, the door handle assembly comprising:

a handle movable from a door latched position to a door unlatched position;

a latch control mechanism operatively connected to the handle so that movement of the handle moves the latch control mechanism;

a counterweight mounted for pivoting about a counterweight axis and free of fixed connection to the latch control mechanism, the counterweight being positioned for contact with the latch control mechanism such that when the handle is pulled from the door latched position to the door unlatched position, the latch control mechanism moves and pushes the counterweight in a first direction about the counterweight axis, but upon acceleration of the handle assembly tending to cause the handle to move by its own inertia from the door latched to the door unlatched position thereby urging the latch control mechanism to move, the inertia of the counterweight urges it to pivot in a second direction about the counterweight axis opposite the first direction and bear against the latch control mechanism for inhibiting rotation of the latch control mechanism and movement of the handle to the door unlatched position;

wherein the counterweight pivots about the counterweight axis less than 20 degrees between the door latch position and door unlatch position when the door handle is pulled.

* * * * *